US008960329B2

(12) United States Patent
Downton

(10) Patent No.: US 8,960,329 B2
(45) Date of Patent: Feb. 24, 2015

(54) STEERABLE PILOTED DRILL BIT, DRILL SYSTEM, AND METHOD OF DRILLING CURVED BOREHOLES

(75) Inventor: Geoff Downton, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 489 days.

(21) Appl. No.: 12/171,459

(22) Filed: Jul. 11, 2008

(65) Prior Publication Data

US 2010/0006341 A1 Jan. 14, 2010

(51) Int. Cl.
*E21B 7/08* (2006.01)
*E21B 10/26* (2006.01)
*E21B 7/06* (2006.01)

(52) U.S. Cl.
CPC ..... *E21B 10/26* (2013.01); *E21B 7/064* (2013.01)
USPC ..... 175/61; 175/40; 175/385

(58) Field of Classification Search
USPC ..... 175/61, 385, 334, 335, 391, 40, 45, 175/320–326
See application file for complete search history.

(56) References Cited

U.S. PATENT DOCUMENTS

| | | | |
|---|---|---|---|
| 1,587,266 | A | 6/1926 | Zublin |
| 1,758,773 | A | 5/1930 | Zublin |
| 2,074,951 | A | 3/1937 | Zublin |
| 3,367,430 | A | 2/1968 | Rowley |
| 4,241,796 | A | 12/1980 | Green et al. |
| 4,408,669 | A | 10/1983 | Wiredal |
| 4,440,244 | A | 4/1984 | Wiredal |
| 4,630,244 | A | 12/1986 | Larronde |
| 4,635,738 | A | 1/1987 | Schillinger et al. |
| 4,706,765 | A | 11/1987 | Lee et al. |
| 5,040,621 | A | 8/1991 | Lof |
| 5,052,503 | A | 10/1991 | Lof |
| 5,113,953 | A | 5/1992 | Noble |
| 5,265,682 | A | 11/1993 | Russell et al. |

(Continued)

FOREIGN PATENT DOCUMENTS

| | | |
|---|---|---|
| RU | 2039186 | 7/1995 |
| RU | 2114273 | 6/1998 |

(Continued)

OTHER PUBLICATIONS

Office action for the equivalent Chinese patent application No. 200980135488.6 issued on Jul. 10, 2013.

(Continued)

*Primary Examiner* — Kenneth L Thompson
(74) *Attorney, Agent, or Firm* — Chadwick A. Sullivan; Wesley Noah

(57) ABSTRACT

The present invention provides apparatus and methods for controlled steering. One embodiment of the invention provides a bit body comprising a trailing end, a pilot section, and a reaming section. The trailing end is adapted to be detachably secured to a drill string. The pilot section is located on a leading, opposite end of the bit body. The reaming section is located intermediate to the leading and trailing ends. The pilot section comprises at least one steering device for steering the pilot section of the bit body, thereby steering the entire bit body. Another embodiment of the invention provides a wellsite system comprising a drill string; a kelly coupled to the drill string; and a bit body as described above. Another embodiment of the invention provides a method of drilling a curved borehole in a subsurface formation.

22 Claims, 5 Drawing Sheets

(56) References Cited

U.S. PATENT DOCUMENTS

| | | | | |
|---|---|---|---|---|
| 5,314,030 | A | 5/1994 | Peterson et al. | |
| 5,520,255 | A | 5/1996 | Barr et al. | |
| 5,553,678 | A | 9/1996 | Barr et al. | |
| 5,553,679 | A | 9/1996 | Thorp | |
| 5,582,259 | A | 12/1996 | Barr | |
| 5,603,385 | A | 2/1997 | Colebrook | |
| 5,655,609 | A * | 8/1997 | Brown et al. | 175/76 |
| 5,673,763 | A | 10/1997 | Thorp | |
| 5,685,379 | A | 11/1997 | Barr et al. | |
| 5,695,015 | A | 12/1997 | Barr et al. | |
| 5,706,905 | A | 1/1998 | Barr | |
| 5,765,653 | A | 6/1998 | Doster et al. | |
| 5,778,992 | A | 7/1998 | Fuller | |
| 5,803,185 | A | 9/1998 | Barr et al. | |
| 5,971,085 | A | 10/1999 | Colebrook | |
| 5,992,548 | A | 11/1999 | Silva et al. | |
| 6,089,332 | A | 7/2000 | Barr et al. | |
| 6,092,610 | A | 7/2000 | Kosmala | |
| 6,158,529 | A | 12/2000 | Dorel | |
| 6,213,226 | B1 * | 4/2001 | Eppink et al. | 175/61 |
| 6,237,404 | B1 | 5/2001 | Crary et al. | |
| 6,244,361 | B1 | 6/2001 | Comeau et al. | |
| 6,298,929 | B1 | 10/2001 | Cobos Rojas | |
| 6,340,064 | B2 | 1/2002 | Fielder et al. | |
| 6,364,034 | B1 | 4/2002 | Schoeffler | |
| 6,394,193 | B1 | 5/2002 | Askew | |
| 6,394,200 | B1 | 5/2002 | Watson et al. | |
| 6,419,033 | B1 * | 7/2002 | Hahn et al. | 175/61 |
| 6,527,512 | B2 | 3/2003 | Bertin et al. | |
| 6,595,303 | B2 | 7/2003 | Noe et al. | |
| 6,926,099 | B2 | 8/2005 | Thigpen et al. | |
| 7,188,685 | B2 | 3/2007 | Downton et al. | |
| 7,207,398 | B2 * | 4/2007 | Runia et al. | 175/61 |
| 7,287,605 | B2 | 10/2007 | Van Steenwyk et al. | |
| 7,334,649 | B2 | 2/2008 | Chen et al. | |
| 7,805,247 | B2 | 9/2010 | Hsu et al. | |
| 7,967,081 | B2 | 6/2011 | Sugiura et al. | |
| 8,004,421 | B2 | 8/2011 | Clark | |
| 8,111,171 | B2 | 2/2012 | Clark | |
| 8,121,788 | B2 | 2/2012 | Bordakov et al. | |
| 8,429,962 | B2 | 4/2013 | Zazovsky et al. | |
| 8,502,696 | B2 | 8/2013 | Clark | |
| 2001/0052428 | A1 | 12/2001 | Larronde et al. | |
| 2002/0011359 | A1 | 1/2002 | Webb et al. | |
| 2005/0211470 | A1 * | 9/2005 | Jeffryes | 175/27 |
| 2006/0131030 | A1 | 6/2006 | Sheffield | |
| 2006/0157283 | A1 | 7/2006 | Hart | |
| 2007/0154341 | A1 | 7/2007 | Saenger | |
| 2007/0202350 | A1 | 8/2007 | Humphreys et al. | |
| 2007/0242565 | A1 | 10/2007 | Hall et al. | |
| 2007/0251726 | A1 | 11/2007 | Menger | |
| 2010/0006341 | A1 | 1/2010 | Downton | |
| 2010/0175925 | A1 | 7/2010 | Ciglenec et al. | |
| 2010/0201540 | A1 | 8/2010 | Li et al. | |
| 2011/0276187 | A1 | 11/2011 | Ciglenec et al. | |
| 2012/0013481 | A1 | 1/2012 | Clark | |
| 2012/0014219 | A1 | 1/2012 | Clark | |
| 2012/0145462 | A1 | 6/2012 | Leising et al. | |
| 2012/0152533 | A1 | 6/2012 | Hoefel et al. | |
| 2012/0160563 | A1 | 6/2012 | Clark et al. | |
| 2012/0160565 | A1 | 6/2012 | Downton et al. | |
| 2013/0022476 | A1 | 1/2013 | Villareal et al. | |
| 2013/0047696 | A1 | 2/2013 | Rasmus et al. | |
| 2013/0048380 | A1 | 2/2013 | Rasmus et al. | |
| 2013/0054146 | A1 | 2/2013 | Rasmus et al. | |
| 2013/0090854 | A1 | 4/2013 | Rasmus et al. | |
| 2013/0090855 | A1 | 4/2013 | Rasmus et al. | |
| 2013/0204534 | A1 | 8/2013 | Anand et al. | |
| 2013/0301389 | A1 | 11/2013 | Alford et al. | |

FOREIGN PATENT DOCUMENTS

| | | |
|---|---|---|
| SU | 152840 | 1/1963 |
| WO | 03008754 | 1/2003 |
| WO | 2007/012858 | 2/2007 |

OTHER PUBLICATIONS

Decision of grant for the equivalent Russian patent applicaiton No. 2011105038 issued on Dec. 16, 2013.

* cited by examiner

STEERABLE PILOTED DRILL BIT, DRILL SYSTEM, AND METHOD OF DRILLING CURVED BOREHOLES

FIELD OF THE INVENTION

The present invention relates to systems and methods for controlled steering (also known as "directional drilling") within a wellbore.

BACKGROUND OF THE INVENTION

Controlled steering or directional drilling techniques are commonly used in the oil, water, and gas industry to reach resources that are not located directly below a wellhead. The advantages of directional drilling are well known and include the ability to reach reservoirs where vertical access is difficult or not possible (e.g. where an oilfield is located under a city, a body of water, or a difficult to drill formation) and the ability to group multiple wellheads on a single platform (e.g. for offshore drilling).

With the need for oil, water, and natural gas increasing, improved and more efficient apparatus and methodology for extracting natural resources from the earth are necessary.

One aspect of this invention is to provide a push the bit rotary steerable solution in situations where a bi-centered bit is required to access the region to be drilled via the completion system in order to drill a larger hole than the access constraints permit for a conventional bit.

SUMMARY OF THE INVENTION

The instant invention provides apparatus and methods for directional drilling. The invention has a number of aspects and embodiments that will be described below.

One embodiment of the invention provides a bit body comprising a trailing end, a pilot section, and a reaming section. The trailing end is adapted to be detachably secured to a drill string. The pilot section is located on a leading, opposite end of the bit body. The reaming section is located intermediate to the leading and trailing ends. The pilot section comprises at least one steering device for steering the pilot section of the bit body, thereby steering the entire bit body.

This embodiment can have several features. For example, the steering device can be a pad, such as a movable pad, such as a fluid-actuated pad. In some embodiments, the steering device includes a piston coupled to the movable pad and an actuator coupled to the piston. The fluid can be drilling mud, as understood by one skilled in the art. In another example, the steering device includes a stationary pad and an orifice located within the stationary pad for discharging a fluid.

The bit body can also include a control device for regulating the movement of at least one steering device. The control device can include, manipulate, or control a valve for controlling the flow of fluid to the steering device. The valve can be electrically and/or mechanically actuated.

The pilot section can rotate independently of the reaming section. The bit body can include a motor such as a fluid-driven motor for rotating the pilot section. The rotational speed of the pilot portion can be faster, slower, or equal to the rotational speed of the reaming portion. The pilot portion can rotate in the same or opposite direction with respect to the reaming section.

The bore of the pilot portion can be less than, greater than, or equal to the bore of the reaming portion.

The bit body may also include a stabilizing ring coupled with the reaming portion for controlling movement of the pilot portion with respect to an axis of rotation extending from the pilot portion through the trailing end.

Another embodiment of the invention provides a method of drilling a curved borehole in a subsurface formation. The method includes mounting a bit body on a drill string; rotating the drill string and bit body, and applying weight against the bit body to urge the pilot section of the bit body against the subsurface formation to cut a pilot borehole; substantially concurrently cutting and enlarging the pilot borehole with the reaming section; and selectively actuating a steering device to urge the pilot bit in a desired direction, thereby drilling a curved borehole. The bit body includes a trailing end adapted to be detachably secured to the drill string, a pilot section on a leading, opposite end of the bit body; and a reaming section intermediate the leading and trailing ends. The pilot section comprises at least one steering device.

DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views and wherein.

DETAILED DESCRIPTION OF THE INVENTION

The present invention provides apparatus and methods for controlled steering. More specifically, the present invention provides a bit body comprising a pilot section comprising at least one steering device and methods for using such a bit body. Such a system allows not only for directional drilling, but also for enhanced vertical drilling because the controlled steering capability allows the bit be return to the desired path if the bit strays.

The bit body is adapted for use in a range of drilling operations such as oil, gas, and water drilling. As such, the bit body is designed for incorporation in wellsite systems that are commonly used in the oil, gas, and water industries. An exemplary wellsite system is depicted in FIG. 1.

Wellsite System

Figure 1:
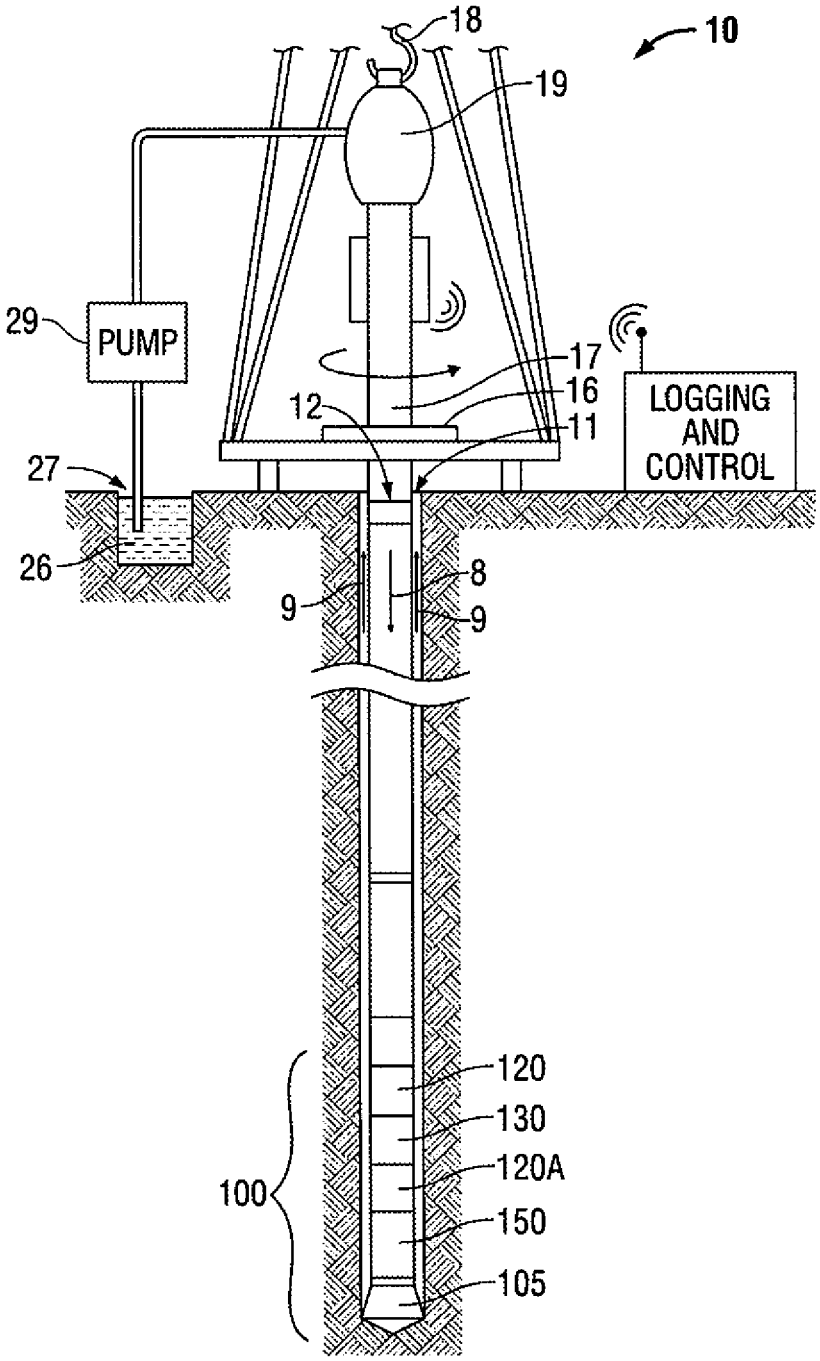
FIG. 1 illustrates a wellsite system in which the present invention can be employed.

FIG. 1 illustrates a wellsite system in which the present invention can be employed. The wellsite can be onshore or offshore. In this exemplary system, a borehole 11 is formed in subsurface formations by rotary drilling in a manner that is well known. Embodiments of the invention can also use directional drilling, as will be described hereinafter.

A drill string 12 is suspended within the borehole 11 and has a bottom hole assembly 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment includes a logging-while-drilling (LWD) module 120, a measuring-while-drilling (MWD) module 130, a roto-steerable system and motor, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In the present embodiment, the LWD module includes a pressure measuring device.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

A particularly advantageous use of the system hereof is in conjunction with controlled steering or "directional drilling." In this embodiment, a roto-steerable subsystem 150 (FIG. 1) is provided. Directional drilling is the intentional deviation of the wellbore from the path it would naturally take. In other words, directional drilling is the steering of the drill string so that it travels in a desired direction.

Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

A directional drilling system may also be used in vertical drilling operation as well. Often the drill bit will veer off of an planned drilling trajectory because of the unpredictable nature of the formations being penetrated or the varying forces that the drill bit experiences. When such a deviation occurs, a directional drilling system may be used to put the drill bit back on course.

A known method of directional drilling includes the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling. Rotary steerable drilling systems for drilling deviated boreholes into the earth may be generally classified as either "point-the-bit" systems or "push-the-bit" systems.

In the point-the-bit system, the axis of rotation of the drill bit is deviated from the local axis of the bottom hole assembly in the general direction of the new hole. The hole is propagated in accordance with the customary three point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953 all herein incorporated by reference.

In the push-the-bit rotary steerable system there is usually no specially identified mechanism to tilt the bit axis from the local bottom hole assembly axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form the drill bit is required to cut side ways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; 5,971,085 all herein incorporated by reference.

Bit Body

Figure 2A:
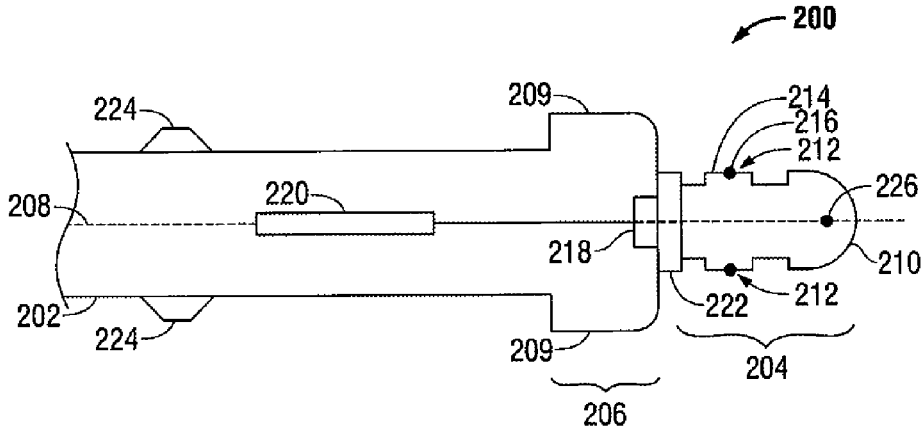
FIG. 2A illustrates a bit body with a steerable pilot section according to one embodiment of the present invention.
Figure 2B:
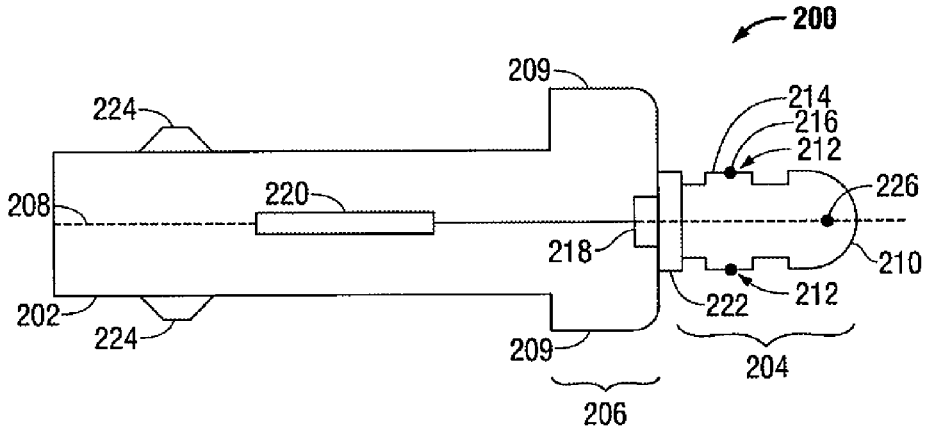
FIG. 2B illustrates a bi-centered bit body with a steerable pilot section according to one embodiment of the present invention.

FIG. 2A depicts a bit body 200 for use as or incorporated within drill bit 105. Bit body 200 includes a trailing end 202, a pilot section 204, and a reaming section 206. Trailing end 202 is adapted for direct or indirect connection with drill string 12. Pilot section 204 is located in the leading edge of the bit body, opposite the trailing edge and usually will be the first portion of the bit body 200 to contact the subsurface formations to be drilled. Reaming section 206 is located in between the pilot section 204 and the trailing end 206 and is designed to remove additional material to form the borehole 11. Longitudinal axis 208 is depicted to illustrate that certain features are, in some embodiments, symmetrical about the longitudinal axis 208 as in FIG. 2A but asymmetrical in FIG. 2B where the reaming section has a wing of radius greater than the pilot bit.

Pilot section 204 and reaming section 206 includes one or more cutting surfaces 210 and 209, respectively. FIG. 2A depicts a simplified cutting surface for simplicity and the invention is accordingly not limited to smooth cutting surfaces as depicted. Rather, in many embodiments, cutting surface will have a contoured surface including a plurality of cutting surfaces. Various suitable cutting surfaces are depicted and described in U.S. Pat. Nos. 1,587,266; 1,758,773; 2,074,951; 3,367,430; 4,408,669; 4,440,244; 4,635,738; 4,706,765; 5,040,621; 5,052,503; 5,765,653; 5,992,548; 6,298,929; 6,340,064; 6,394,200; 6,926,099; 7,287,605; and 7,334,649 all herein incorporated by reference. One skilled in the art will readily recognize that the contoured shape of the cutting surfaces 209 and 210 may be similar nature, or may be different contoured shapes. In some embodiments, the cutting surface will comprise a material selected for hardness such as polycrystalline diamond (PCD).

Additionally, the cutting surfaces 209 and 210 may be manufactured from the same material or in the alternative may be manufactured from different materials. In view of the above, a variety of alternative cutting surface contour shapes and materials may be utilized in practicing the present invention such that shape and materials can be selected to meet the steering and drilling requirements of the present invention. For example, one embodiment of the invention can employ an aggressive pilot cutting surface 210 with a less aggressive reaming cutting surface 209. Another embodiment can employ an aggressive reaming cutting surface 209 with a less aggressive pilot cutting portion 210.

By selecting, pairing, and configuring various cutting surface shapes and materials, a bit body 200 can be optimized for properties such as wear resistance, drilling speed, rate of penetration, and the like. For example, recognizing that the larger radius of the reaming section may results in increased loads and rotational velocity of the reaming cutting surface 210 relative to pilot cutting surface 209, reaming cutting surface 210 can be designed with a less aggressive profile than pilot cutting surface 209. A less aggressive cutting surface can include cutters or teeth that extend a smaller distance from the rest of cutting surface 209 than similar cutters or teeth on cutting surface 210, so that the cutters or teeth of cutting surface 209 engage relatively less material than the cutters or teeth of cutting surface 210. Bit body 200 can be further optimized to achieve ideal performance in specific geologic conditions and formations.

Steering Devices

Pilot section 204 also includes one or more steering devices 212 for steering the pilot section of the bit. Some embodiments employ a push-the-bit system as described herein. In such a system, steering is accomplished by exerting a force against the walls of the borehole 11 (not shown) to urge the pilot bit in the desired direction of hole propagation. Additional sensors and data acquisition elements 226 may be disposed within the pilot section 204 to measure the region of the formation in contact with the pilot section 204 or to measure drilling dynamics data.

Two principle steering devices are discussed herein: movable pads and stationary pads where movement is relative to the axis of the bit. It will be noted that these pads may rotate with the bit, they may remain nominally geostationary, or some combination thereof. Additional steering devices, now known and later developed are within the scope of this invention including but not limited to the use of fluid pressure in steering aspects of the present invention.

A variety of devices are suitable for imparting a sufficient force to move the pilot section 204. Such devices includes movable pads such as those described in U.S. Pat. Nos. 5,265,682; 5,520,255; 5,553,679; 5,582,259; 5,603,385; 5,673,763; 5,778,992; and 5,971,085; and U.S. Patent Publication No. 2007/0251726. Other suitable devices include pistons and/or cams such as those described in U.S. Pat. Nos. 5,553,678 and 6,595,303 and U.S. Patent Publication No. 2006/0157283. Each of the recited patents is herein incorporated by reference.

Figure 2C:
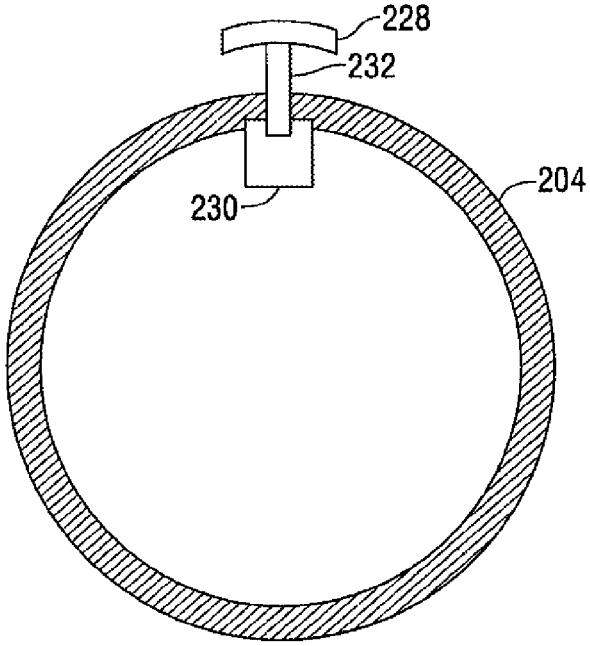
FIG. 2C illustrates a cross-section of a pilot section comprising piston-actuated movable pad.

FIG. 2C depicts a piston-actuated movable pad, located on the pilot section 204 of bit body 200. Movable pad 228 normally lies substantially in gauge with pilot section 204. Actuator 230 applied a force to piston 232 urging movable pad 228 into contact with the borehole walls. The representation of a piston-actuated moveable pad is solely for illustration purposes and is not intended to be limited on scope. One skilled in the art will readily recognize that the actuation force for moving a pad may take numerous forms including the aforementioned piston actuated arrangement as well as numerous suitable alternative from the mechanical, electrical, electromechanical, and/or pneumatic/hydraulic arts.

Figure 2D:
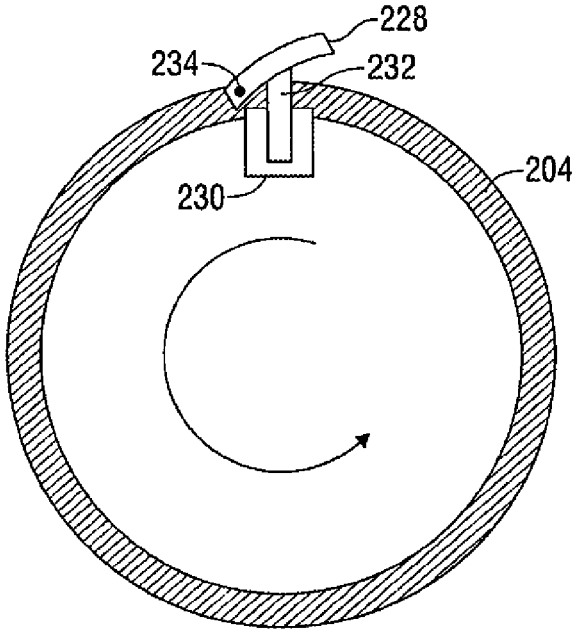
FIGS. 2D and 2E illustrate a cross-section of a pilot section comprising hinged piston-actuated movable pads.
Figure 2E:
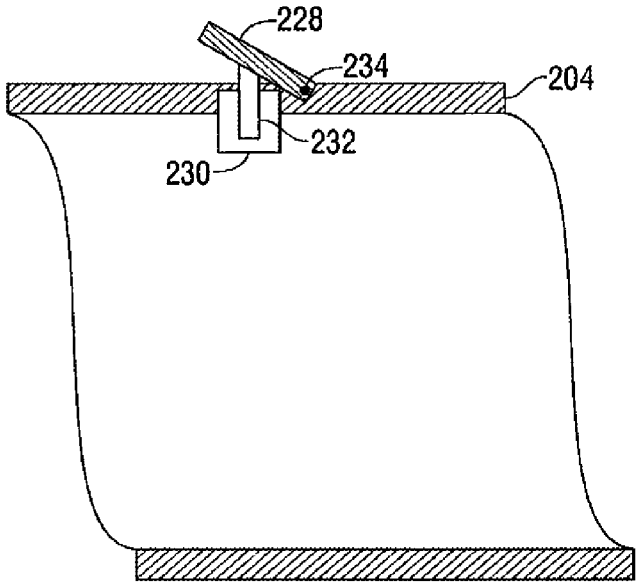

FIG. 2D depicts another embodiment of piston-actuated hinged movable pad. Movable pad 228 is actuated similarly to the system depicted in FIG. 2C, except that movable pad 228 is connected to pilot section 204 by hinge 234. The pivot formed by hinge 234 need not be parallel to axis of rotation 208, but rather may be orthogonal to the axis of rotation 208 as depicted in FIG. 2E. As set forth previously, the piston actuated hinged moveable pad is not intended to be limiting in scope and may be readily replaced with a suitable alternative as understood by one skilled in the art.

Additionally or alternatively, fluid pressure can be used to directly move the pilot section 204. As depicted in FIG. 2A, some embodiments of steering device 212 include a stationary pad 214 and one or more orifices for 216 for selectively releasing a fluid to steer the pilot section 204; here the motive force is created by the trapped pressure between the pad and the rock as the mud squeezes out to join the return flow to the surface. The fluid (in some embodiments, mud) is provided through the interior of the drill string 12 and the bit body 200 as described herein. The fluid is generally at high pressure and generally incompressible but this does not exclude the use of multi phase fluids where the required trapped pressure can be achieved. When the fluid exits the orifice 216, the fluid creates pressure between the stationary pad 214 and the wall of the borehole 11.

In some embodiments, stationary pads 214 are sized to closely match the diameter of the cutting surface 210 of the pilot portion 204. Larger stationary pads 214 will result in a smaller gap between the pads 214 and the wall of the borehole 11, resulting in greater pressure when fluid is selectively released from the orifice 216. Also, stationary pads 214 with larger surface areas will produce higher pressures and therefore greater steering force. Accordingly, some embodiments of the invention employ a continuous stationary pad 214 or no stationary pads 214, but rather size all or some of the non-cutting portions of the pilot section 204 to the same diameter as the cutting surfaces 210.

Stationary pads 214 and movable pads 228 are designed to withstand substantial forces and temperatures. Accordingly, some embodiments of stationary pads 214 and movable pads 228 are constructed of metals such as steel, titanium, brass, and the like. Other embodiments of stationary pads 214 and movable pads 228 include a hardface or wear resistance coating, such as a coating including ceramic carbide inserts, to provide increased service life. Suitable coatings are described, for example, in U.S. Patent Publication No. 2007/0202350, herein incorporated by reference.

Steering device 212 can be actuated using a variety of technologies. In some embodiments, steering device 212 is actuated by an electrical, mechanical, or electromechanical device such a gears, threads, servos, motors, magnets, and the like. In other embodiments, steering device is hydraulically actuated, for example by mud flowing through the drill string 12 acting on a rotary valve. Suitable devices for actuating a steering device are provided, for example, in U.S. Pat. No. 5,553,678, herein incorporated by reference.

Figure 3:
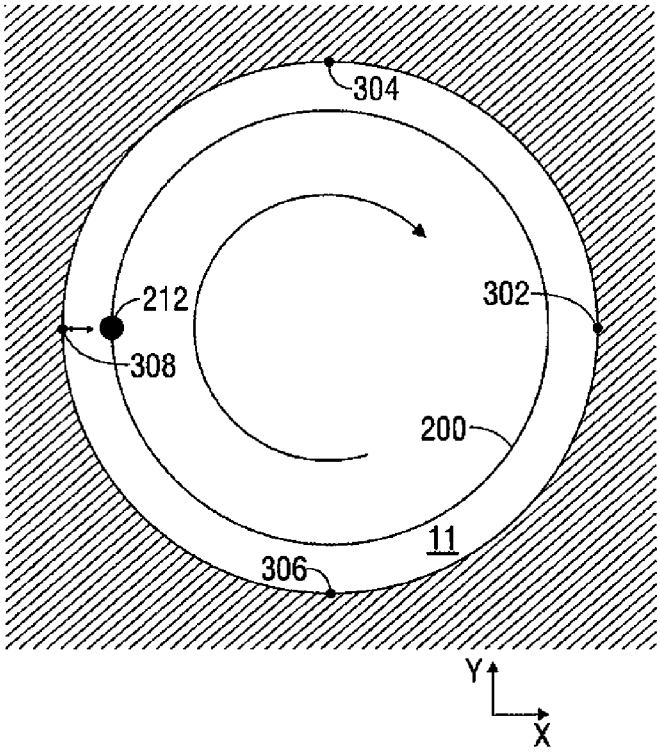
FIG. 3 illustrates a cross-section of a bit body located within a borehole according to one embodiment of the present invention.

In order to urge the bit body 200 in a desired direction, steering device 212 is selectively actuated with respect to the rotational position of the steering device. For illustration, FIG. 3 depicts a borehole 11 within a subsurface formation. A cross section of bit body 200 is provided to illustrate the placement of steering device 212. In this example, an operator seeks to move bit body 212 (rotating clockwise) towards point 302, a point located entirely within the x direction relative to the current position of bit body 200. Although steering device will generate a force vector having an positive x-component if steering device is actuated at any point when steering device 212 is located on the opposite side of borehole 11 between points 304 and 306, steering device will generate the maximum amount of force in the x direction if actuated at point 310. Accordingly, in some embodiments, the actuation of steering device 312 is approximately periodic or sinusoidal, wherein the steering device 212 begins to deploy as steering device passes point 306, reaches maximum deployment at point 308, and is retracted by point 304.

In some embodiments, a rotary valve 218 (also referred to a spider valve) may be used to selectively actuate steering device 212. Suitable rotary valves are described in U.S. Pat. Nos. 4,630,244; 5,553,678; 7,188,685; and U.S. Patent Publication No. 2007/0242565, all herein incorporated by reference.

In some embodiments, the pilot section contains more than one steering device 212. Multiple steering devices 212 can be located symmetrically about the pilot section 204. For example, steering devices 212 can be located a fixed distance from the leading and/or trailing edge of the bit body 200 and evenly spaced (e.g. 120 degrees on center for a pilot section 204 with three steering devices 212). In alternative embodiments, steering devices 212 are irregularly located or clustered.

Referring again to FIG. 2A, bit body 200 may further include a control unit 220 for selectively actuating steering devices 212. Control unit 220 maintains the proper angular position of the bit body 200 relative to the subsurface formation. In some embodiments, control unit 220 is mounted on a bearing that allow control unit 220 to rotate freely about the axis 208 of the drill string. The control unit 220, according to some embodiments, contains sensory equipment such as a three-axis accelerometer and/or magnetometer sensors to detect the inclination and azimuth of the bit body 200. The control unit 220 may further communicate with sensors disposed within elements of the bit body (such as 209, 210, 212, etc.) such that said sensors can provide formation characteristics or drilling dynamics data to control unit 220. Formation characteristics can include information about adjacent geologic formation gather from ultrasound or nuclear imaging devices such as those discussed in U.S. Patent Publication No. 2007/0154341, the contents of which is hereby incorporated by reference herein. Drilling dynamics data may include measurements of the vibration, acceleration, velocity, and temperature of the bit body (such as 209, 210, 212, etc.). The sensors described herein may located in one or more regions of the bit body 200 including, but not limited to, pilot section 204 and reaming section 206.

In some embodiments, control unit 220 is programmed above ground to following an desired inclination and direction. The progress of the bit body 200 can be measured using MWD systems and transmitted above-ground via a sequences of pulses in the drilling fluid, via an acoustic or wireless transmission method, or via a wired connection. If the desired path is changed, new instructions can be transmitted as required. Mud communication systems are described in U.S. Patent Publication No. 2006/0131030, herein incorporated by reference. Suitable systems are available under the POWER-PULSE™ trademark from Schlumberger Technology Corporation of Sugar Land, Tex.

Stabilizing Ring

In accordance with one embodiment of the present invention, the stabilizing ring may simply be a "dumb stabilizer" orientated in proximity to the reamer such that the forces from the reamer are isolated from the pilot bit. In accordance with an alternative embodiment, the stabilizer ring may freely rotate. In an alternative embodiment, as understood by one skilled in the art, the stabilizer ring may be moved such that it can move radially outwards by mud (not unlike the pads) to dampen lateral drilling motions. Finally, one skilled in the art will recognize that the aforementioned referenced to pads may dispended with in part or in whole, such that eccentric displacements of the stabilizer ring may be utilized in pushing the pilot bit.

In other embodiments, bit body 200 further comprises a stabilizing ring 222 located between the pilot section 204 and the reaming section 206. Stabilizing ring 222 can be coupled with either pilot section 204 or reaming section 206 or may rotate freely between pilot section 204 and reaming section 206. In some embodiments, stabilizing ring regulates the motion or flexation of the pilot portion with respect to the rotation axis 208 of bit body 200 and/or reaming section 206. In other embodiments, stabilizing ring dampens vibrations generated by the operation of the pilot section.

Figure 4A:
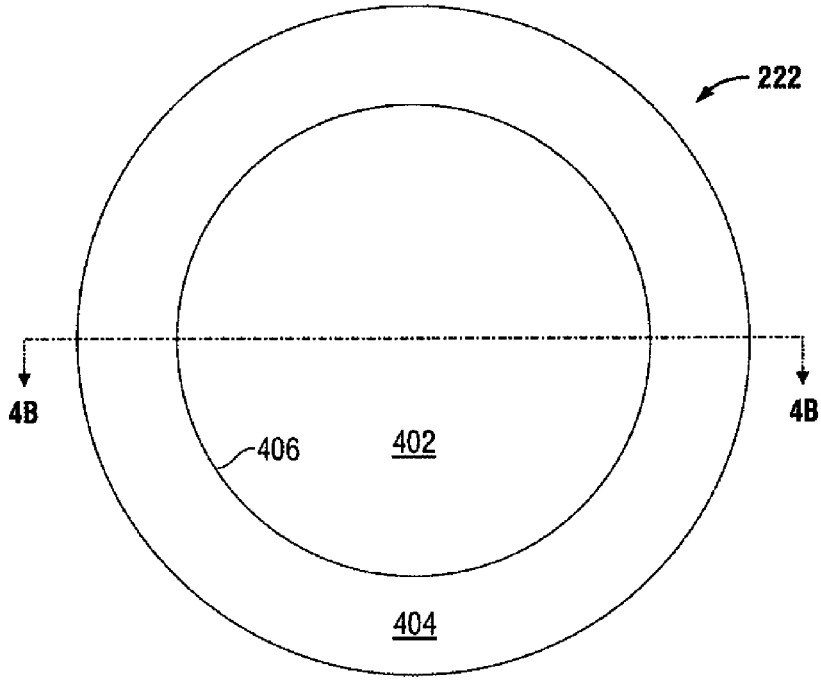
FIGS. 4A and 4B illustrate a top and cross-sectional view of a stabilizing ring according to one embodiment of the present invention.
Figure 4B:
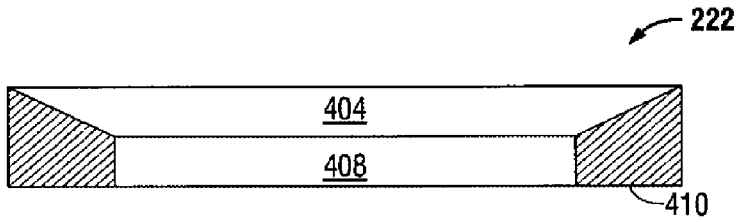

FIGS. 4A and 4B depict an exemplary stabilizing ring 222. Stabilizing ring includes a hole 402 for receiving the pilot section 204. Some embodiments also include an angled portion 404 that contacts the pilot section 204 and a flat portion which contacts reaming section 206 to regulate flexation. In other embodiments, angled portion 404 is rounded. In still further embodiments, the edges 406 between angled portion and interior surface 408 is rounded or chamfered.

In some embodiments, stabilizing ring 222 includes one or more holes between angled portion 404 and flat portion 410. The holes allow for a plurality of pins to pass through stabilizing ring 222 to rotationally link pilot section 204 and reaming section 206. Such linkage may be ideal in situations where the same rotational speed is desired for both sections 204 and 206. The linkage allows rotation of both sections 204 and 206 without a mud motor.

Stabilizing ring 222 ideally is designed to withstand substantial forces and temperatures. Accordingly, some embodiments of stabilizing ring 222 are constructed of metals such as steel, titanium, brass, and the like. Other embodiments of stabilizing ring 222 include abrasion resistant coating such ceramics or impact absorbing coatings containing materials such as elastomers.

Some embodiments of the invention are designed for fast replacement of stabilizing ring 222. For example, stabilizing ring 222 can consist of two or more semi-circular pieces fastened with screws, bolts, latches, and the like. Such a design permits the replacement of stabilizing ring 222 without the removal of pilot section 204.

By regulating flexation of the pilot section 204, the stabilizing ring 222 transfers the lateral forces applied to the pilot section 204 as a result of steering device 212, thereby causing the reaming section 206 to deflect and drill a curved borehole. One skilled in the art will additionally recognize that steering of the pilot bit may be further provided or supplemented by selectively varying the rotational torque or velocity and/or counter-rotation torque or velocity of the pilot relative to the reamer. Additionally, the weight on the bit (WOB) may be modulated to ensure that the cutting process of the pilot and reamer are reasonably matched.

In further embodiments, the pilot section 204 rotates independently of reaming section 206. For example, the pilot section 204 can rotate faster, slower, or at the same speed at the reaming section 206. Additionally, pilot section 204 can rotate in the same or the opposite direction as the reaming section 206. The pilot section 204 and reaming section 206 can be configured to rotate at any speed as would be advantageous for a particular embodiment, for example between one revolution per minute to 10,000 revolutions per minute.

In some embodiments, pilot section 204 and/or reaming section 206 are rotated by a mud motor (not shown). A mud motor is a positive displacement drilling motor that uses hydraulic horsepower of the drilling fluid to drive a bit body. An exemplary mud motor is described in U.S. Pat. No. 6,527,512, herein incorporated by reference. Mud motors are available under the SPERRY FLEX®, SLICKBORE®, and SPERRY DRILL® trademarks from the Sperry Drilling Services division of Halliburton of Houston, Tex. Additionally or alternatively, pilot section 204 and/or reaming section 206 can be rotated by a drill string 12 or another source of propulsion such as battery-powered motor.

In a further embodiment, bit body 200 includes one or more stabilizing pads 224. Stabilizing pads act in a similar manner to steering devices 212 to support the trailing portions of the bit body 200 and/or the drill string 12 and prevent undesired flexation.

As depicted in FIG. 2A, bit body 200*a* may be a bi-centered bit. A bi-centered bit is characterized by eccentric reaming section 206*a* in which a first cutting surface 209*a* of the reaming section extends farther from the axis of rotation 208 than a second cutting surface 209*b* of the reaming section.

The foregoing specification and the drawings forming part hereof are illustrative in nature and demonstrate certain preferred embodiments of the invention. It should be recognized and understood, however, that the description is not to be construed as limiting of the invention because many changes, modifications and variations may be made therein by those of skill in the art without departing from the essential scope, spirit or intention of the invention.

What is claimed is:

1. A drill bit comprising:
- a unitary bit body, comprising:
  - a trailing end adapted to be detachably secured to a drill string;
  - a pilot section on a leading, opposite end of the bit body; and
  - a reaming section intermediate the leading and trailing ends;
  - wherein the pilot section comprises at least one steering device for steering the pilot section of the bit body, thereby steering the entire bit body, wherein the steering device comprises a stationary pad; and an orifice for discharging a fluid located within the stationary pad.

2. The drill bit of claim 1, wherein the steering device comprises:
- a movable pad.

3. The drill bit of claim 2, wherein the movable pad is a fluid-actuated.

4. The drill bit of claim 3, wherein the fluid is mud.

5. The drill bit of claim 1, wherein the fluid is mud.

6. The drill bit of claim 1, further comprising:
- a control device for regulating the operation of the at least one steering device.

7. The drill bit of claim 1, further comprising a stabilizing ring coupled with the reaming portion for controlling movement of the pilot portion with respect to an axis of rotation extending from the pilot portion through the trailing end.

8. The drill bit of claim 1, wherein the pilot section comprises a cutting surface and the reaming section comprises a cutting surface, the cutting surface of the reaming section configured to be less aggressive than the cutting surface of the pilot section.

9. The drill bit of claim 1 further comprising:
- a sensor in communication with at least one of said pilot section or reaming section.

10. The drill bit of claim 1, wherein said steering device rotates with the bit body.

11. The drill bit of claim 1, wherein said steering device is nominally geostationary relative to the bit body.

12. A wellsite system comprising:
- a drill string;
- a kelly coupled to the drill string; and
- a bottom hole assembly having a bit body at its lower end, the bit body comprising:
  - a trailing end adapted to be detachably secured to a drill string;
  - a pilot section on a leading, opposite end of the bit body;
  - a reaming section intermediate the leading and trailing ends; and
  - a stabilizer ring located between the pilot section and the reaming section, the stabilizer ring comprising a hole for receiving the pilot section, a flat portion which contacts the reaming section, and an angled portion which contacts the pilot section;
  - wherein the pilot section comprises at least one steering device for steering the pilot section of the bit body, thereby steering the entire bit body while the stabilizer ring regulates flexation of the pilot section and also transfers lateral forces applied to the pilot section so as to cause the reaming section to deflect.

13. A method of drilling a curved borehole in a subsurface formation comprising:
- mounting a bit body on a drill string, the bit body comprising:
  - a trailing end adapted to be detachably secured to the drill string;
  - a pilot section on a leading, opposite end of the bit body; and
  - a reaming section coupled directly to the pilot section intermediate the leading and trailing ends;
  - wherein the pilot section comprises at least one steering device;
- rotating at least a portion of the drill string and bit body, and applying weight against the bit body to urge the pilot section of the bit body against the subsurface formation to cut a pilot borehole;
- substantially concurrently cutting and enlarging the pilot borehole with the reaming section;
- selectively actuating the steering device to urge the pilot bit in a desired direction, thereby drilling a curved borehole;

collecting data from a plurality of sensors located on the steering device and on cutting surfaces of at least one of the pilot section and the reaming section; and communicating the data to a control unit located in the bit body.

14. The method of claim 13, wherein the steering device comprises:

a movable pad.

15. The moveable pad of claim 14, wherein said pad is a fluid-actuated.

16. The method of claim 14, wherein the steering device further comprises:

a piston coupled to the movable pad; and an actuator coupled to the piston.

17. The method of claim 13, wherein the steering device comprises:

a stationary pad; and an orifice for discharging a fluid located within the stationary pad.

18. The method of claim 13, further comprising the step of regulating the operation of the at least one steering device using the control device.

19. The method of claim 13, further comprising the step of controlling at least one of rotational velocity, torque or direction of the pilot portion relative to the reaming portion.

20. The method of claim 13, further comprising the step of providing a stabilizing ring in communication with the reaming portion for controlling movement of the pilot portion with respect to an axis of rotation extending from the pilot portion through the trailing end.

21. The method of claim 13, wherein said steering device rotates with the bit body.

22. The method of claim 13, wherein said steering device is nominally geostationary relative to the bit body.

* * * * *